US007435033B1

(12) United States Patent
Esbenshade

(10) Patent No.: US 7,435,033 B1
(45) Date of Patent: Oct. 14, 2008

(54) VEHICLE DIVERTING SYSTEM

(76) Inventor: Gary M. Esbenshade, 3315 Crider Rd., Mansfield, OH (US) 44903

( * ) Notice: Subject to any disclaimer, the term of this patent is extended or adjusted under 35 U.S.C. 154(b) by 0 days.

(21) Appl. No.: 12/015,257

(22) Filed: Jan. 16, 2008

(51) Int. Cl.
*E01F 13/12* (2006.01)

(52) U.S. Cl. ..... 404/6; 404/10; 49/49

(58) Field of Classification Search ..... 404/6, 404/9, 10; 49/49
See application file for complete search history.

(56) References Cited

U.S. PATENT DOCUMENTS

| | | | | | |
|---|---|---|---|---|---|
| 1,527,107 | A | * | 2/1925 | Allen | 238/3 |
| 1,766,073 | A | * | 6/1930 | Hartzler et al. | 404/10 |
| 1,901,333 | A | * | 3/1933 | Parkhurst | 404/10 |
| 2,918,740 | A | * | 12/1959 | Smith | 49/49 |
| 3,295,255 | A | | 1/1967 | Russo | |
| 3,340,779 | A | * | 9/1967 | Mahoney | 404/10 |
| 3,851,616 | A | * | 12/1974 | Brown | 116/63 R |
| 3,890,054 | A | * | 6/1975 | O'Connor | 404/10 |
| 3,963,362 | A | * | 6/1976 | Hollis | 404/10 |
| 4,101,235 | A | * | 7/1978 | Nelson | 404/6 |
| 4,158,514 | A | * | 6/1979 | Dickinson | 404/6 |
| 4,367,975 | A | | 1/1983 | Tyers | |
| 4,511,281 | A | * | 4/1985 | Schmanski | 404/10 |
| 5,059,060 | A | | 10/1991 | Steinhardt | |
| 5,498,102 | A | | 3/1996 | Bissell | |
| 5,538,358 | A | | 7/1996 | Scrimshaw | |
| D415,974 | S | | 11/1999 | Arellano | |
| 6,301,831 | B1 | | 10/2001 | Cundy et al. | |

FOREIGN PATENT DOCUMENTS

DE 29182562 * 12/1998

* cited by examiner

*Primary Examiner*—Gary S Hartmann

(57) ABSTRACT

A vehicle diverting system includes a driveway has an upper surface. A trough extends into the upper surface. The trough is elongated and extends between lateral edges of the driveway. A housing has a first end and a second end. The first end is rotatably coupled to a first lateral wall of the trough and the second end is rotatably coupled to a second lateral wall of the trough. The housing has a peripheral wall extending between the first and second ends. A plurality of spike shaped protrusions is attached to and extends away from the peripheral wall. The protrusions are comprised of a resiliently flexible material that is incapable of puncturing a vehicle tire. The protrusions are positionable in a deployed position extending upwardly from a plane of the upper surface or in a stored position positioned within the trough.

15 Claims, 9 Drawing Sheets

FIG. 8
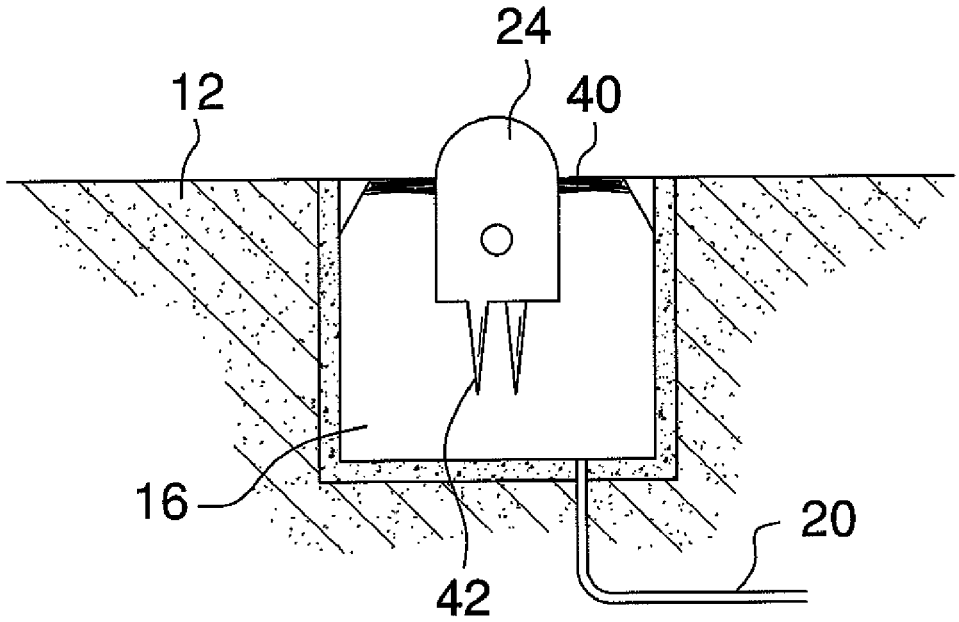
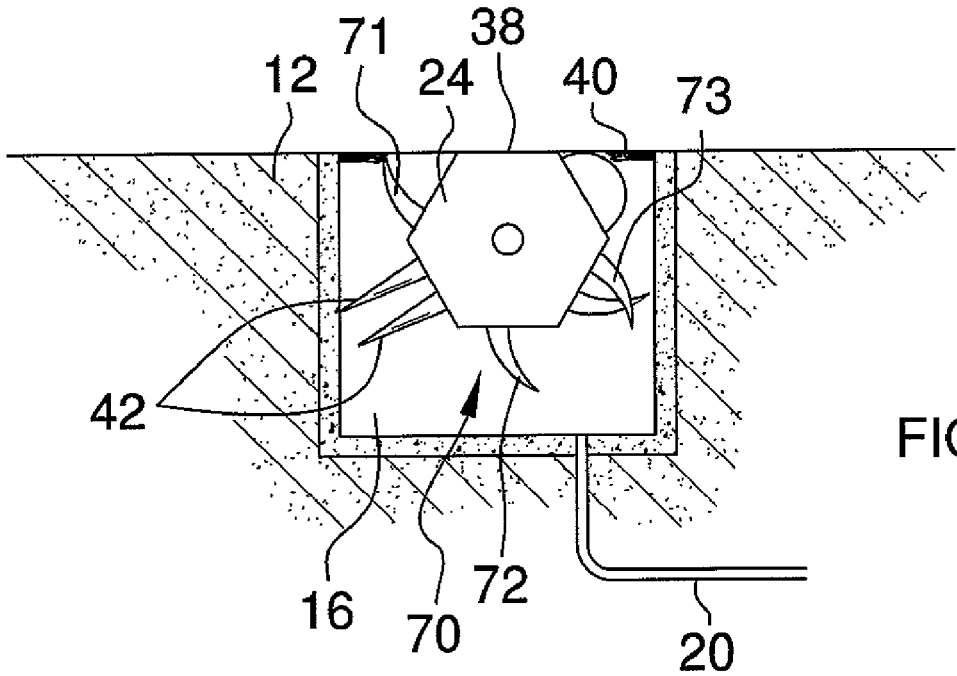
FIG. 9

VEHICLE DIVERTING SYSTEM

BACKGROUND OF THE INVENTION

Field of the Invention

The present invention relates to vehicle diverting devices and more particularly pertains to a new vehicle diverting device for preventing and diverting a unwelcome vehicles from entering a driveway.

SUMMARY OF THE INVENTION

The present invention meets the needs presented above by generally comprising a driveway has an upper surface. A trough extends into the upper surface. The trough is elongated and extends between lateral edges of the driveway. A housing has a first end and a second end. The first end is rotatably coupled to a first lateral wall of the trough and the second end is rotatably coupled to a second lateral wall of the trough. The housing has a peripheral wall extending between the first and second ends. A plurality of spike shaped protrusions is attached to and extends away from the peripheral wall. The protrusions are comprised of a resiliently flexible material that is incapable of puncturing a vehicle tire. The protrusions are positionable in a deployed position extending upwardly from a plane of the upper surface or in a stored position positioned within the trough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a side view of another embodiment of the housing of the present invention.

FIG. 9 is a side view of another embodiment of the housing of the present invention.

DESCRIPTION OF THE PREFERRED EMBODIMENT

Figure 1:
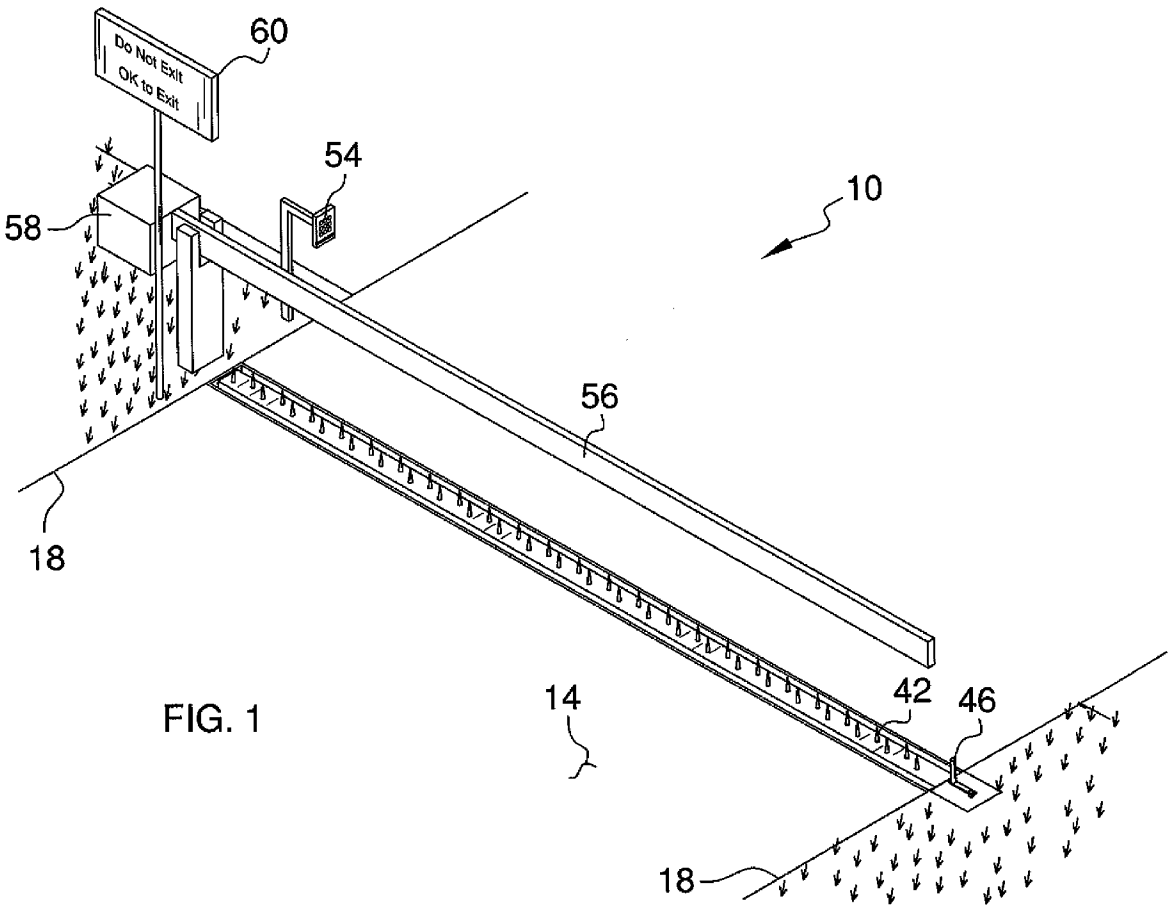
FIG. 1 is a perspective view of a vehicle diverting system according to the present invention.

With reference now to the drawings, and in particular to FIGS. 1 through 14 thereof, a new vehicle diverting device embodying the principles and concepts of the present invention and generally designated by the reference numeral 10 will be described.

As best illustrated in FIGS. 1 through 14, the vehicle diverting system 10 generally comprises a driveway 12 that has an upper surface 14. An elongated trough 16 extends into the upper surface 14 and extends between lateral edges 18 of the driveway 12. A drainage conduit 20 may be fluidly coupled to the trough 16 and drains water from the trough 16 to prevent the trough 16 from filling with water. A screen 21 may positioned over an inlet of the conduit 20 to prevent debris from entering the conduit 20. A heating assembly 22, which may include one or more heating elements, may be in thermal communication with the trough 16 and warm the trough 16 to a temperature above 0° Celsius. The heating assembly 22 prevents snow and ice from accumulating in the trough 16. The heating assembly 22 may be programmed to detect a temperature below 0° Celsius and be automatically turned on when that temperature threshold has been passed.

A housing 24 has a first end 26 and a second end 28. The first end 26 is rotatably coupled to a first lateral wall 30 of the trough 16 and the second end 28 is rotatably coupled to a second lateral wall 32 of the trough 16. The first 26 and second 28 ends may be rotatably coupled to the first 30 and second 32 lateral walls of the trough 16 by rods 34 extending outwardly from the housing 24. The housing 24 has a peripheral wall 36 extending between the first 26 and second 28 ends. FIGS. 5-9 depict variously shaped housings 24 which may include one or more planar sides 38 for easier driving over the trough 16. FIGS. 8 and 9 include bristles 40 extending toward and abutting the housing 24 to prevent objects from falling into the trough 16.

Figure 5:
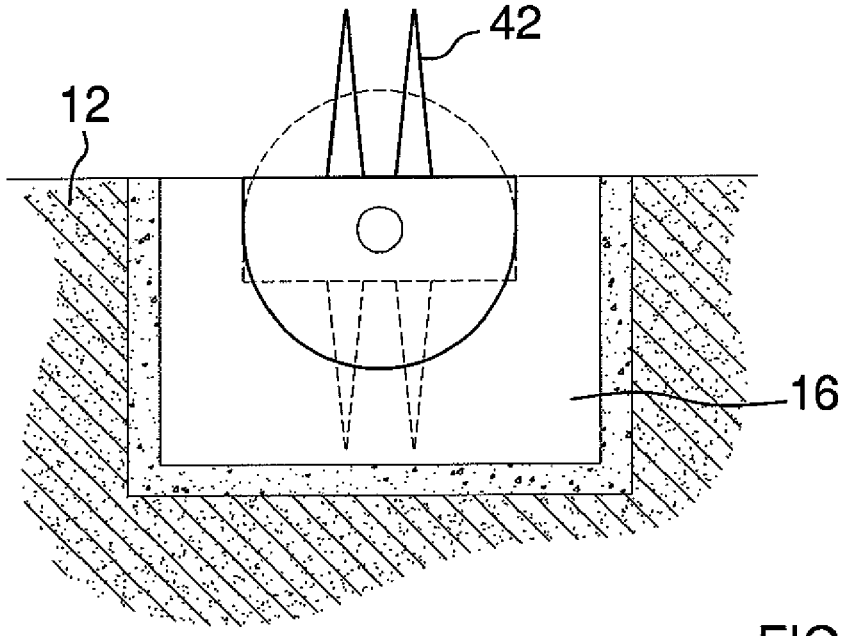
FIG. 5 is a side view of a housing of the present invention.
Figure 6:
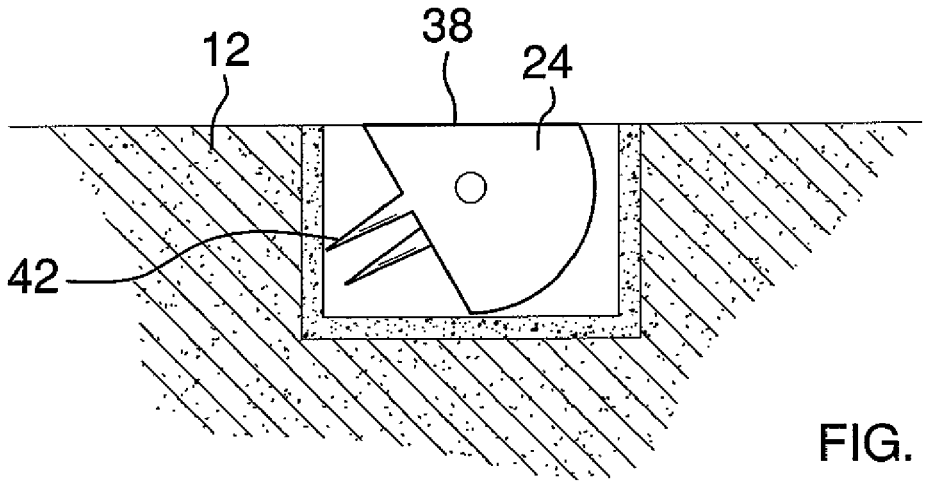
FIG. 6 is a side view of another embodiment of the housing of the present invention.
Figure 7:
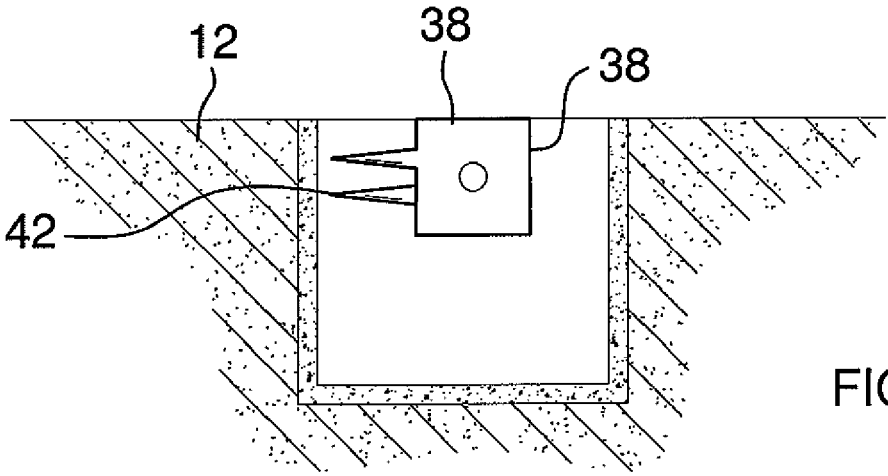
FIG. 7 is a side view of another embodiment of the housing of the present invention.

A plurality of spike shaped protrusions 42 is attached to and extends away from the peripheral wall 36. The protrusions 42 are comprised of a resiliently flexible material that is incapable of puncturing a vehicle tire 8. The resiliently flexible material may comprise an elastomeric material. The protrusions 42 are positionable in a deployed position extending upwardly from a plane of the upper surface 14 or in a stored position positioned within the trough 16. The protrusions 42 are aligned with each from the first end 26 to the second end 28 of the housing 24. The protrusions 42 may be aligned with each other in a pair of rows as is shown in FIGS. 1 and 5.

Figure 2:
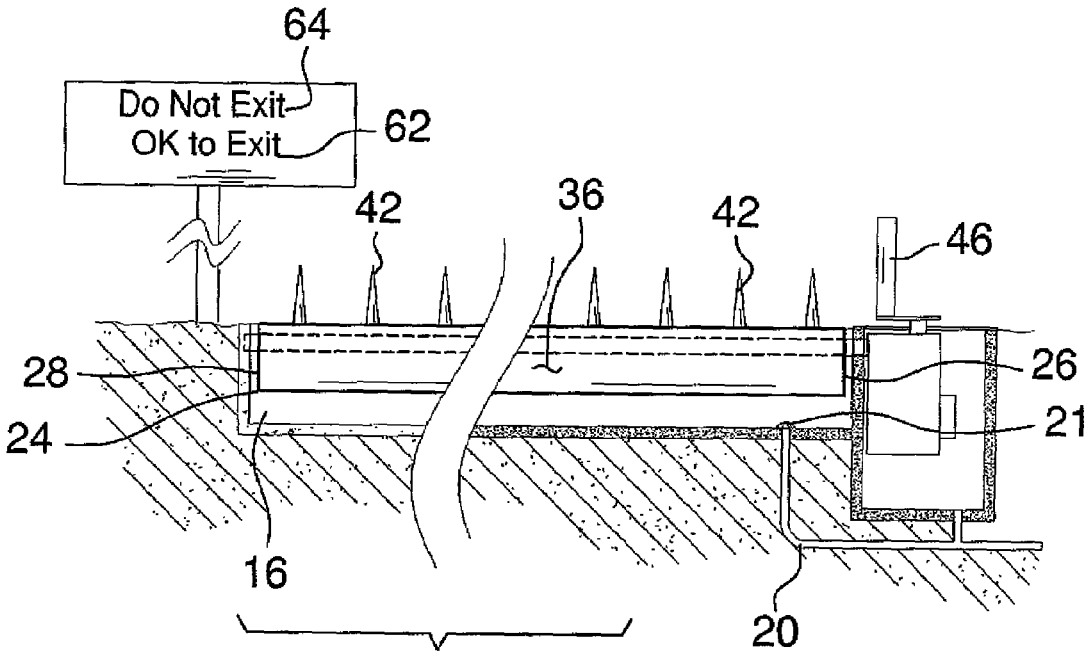
FIG. 2 is a cross-sectional view of the present invention showing a hand actuated drive mechanism.
Figure 3:
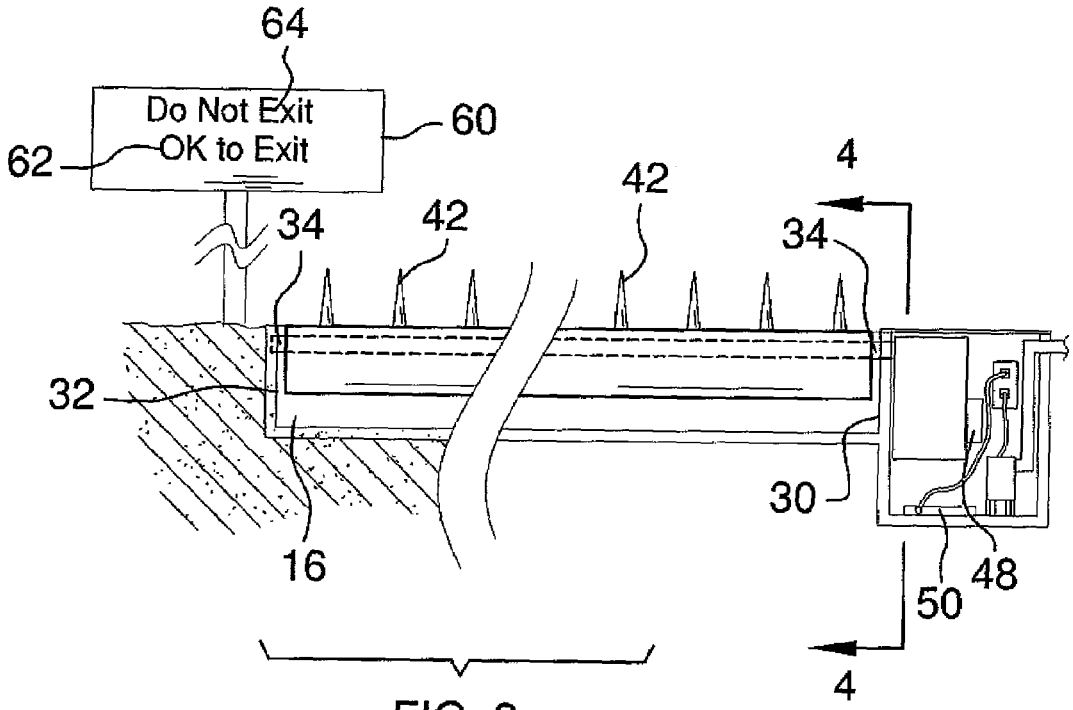
FIG. 3 is a cross-sectional view of the present invention showing a motor actuated drive mechanism.
Figure 4:
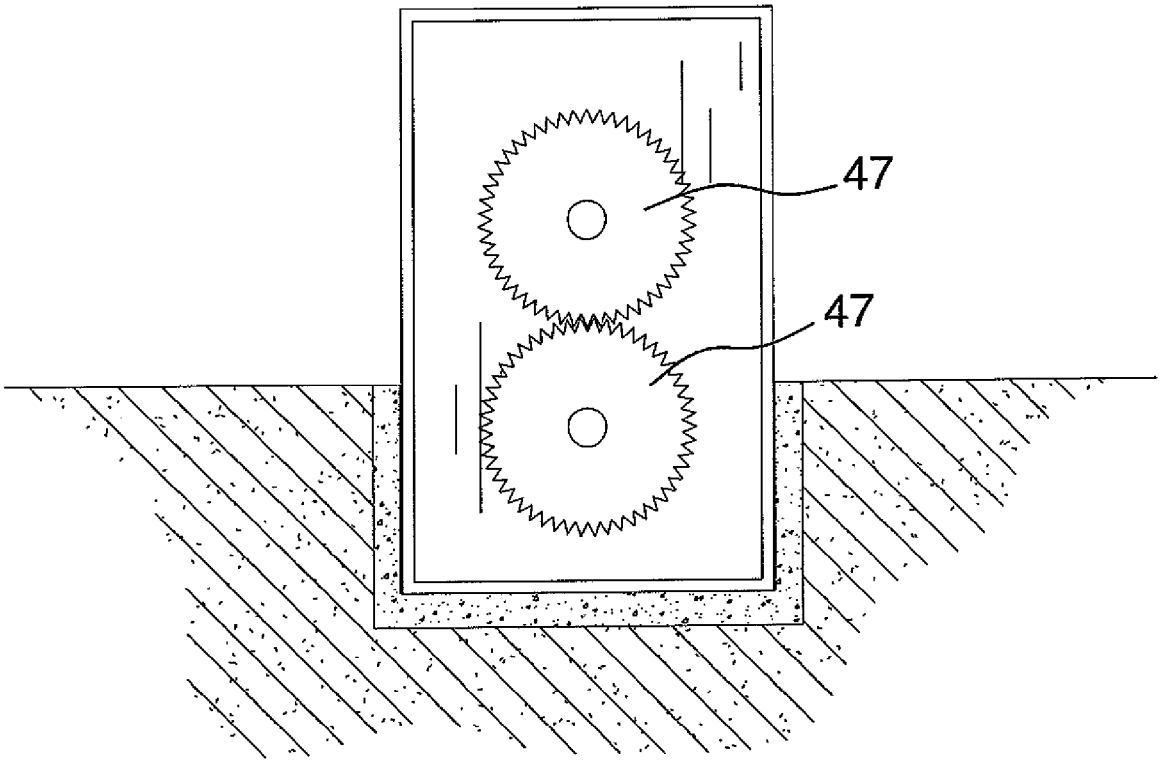
FIG. 4 is a cross-sectional view taken along 4-4 of FIG. 3 of the present invention.
Figure 10:
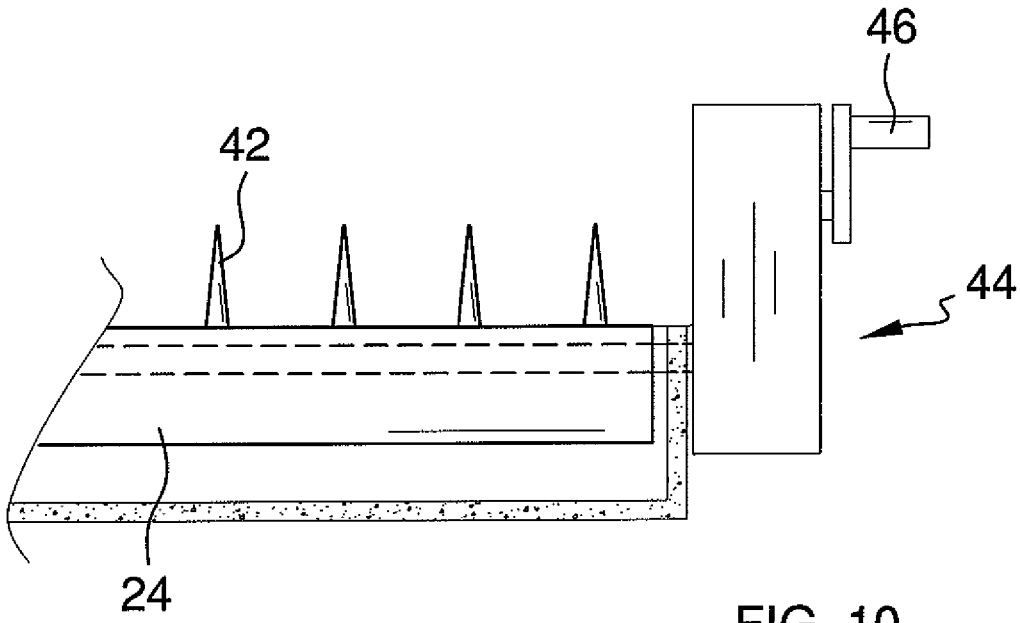
FIG. 10 is a front view of the housing of the present invention showing an alternate hand actuated drive mechanism.
Figure 11:
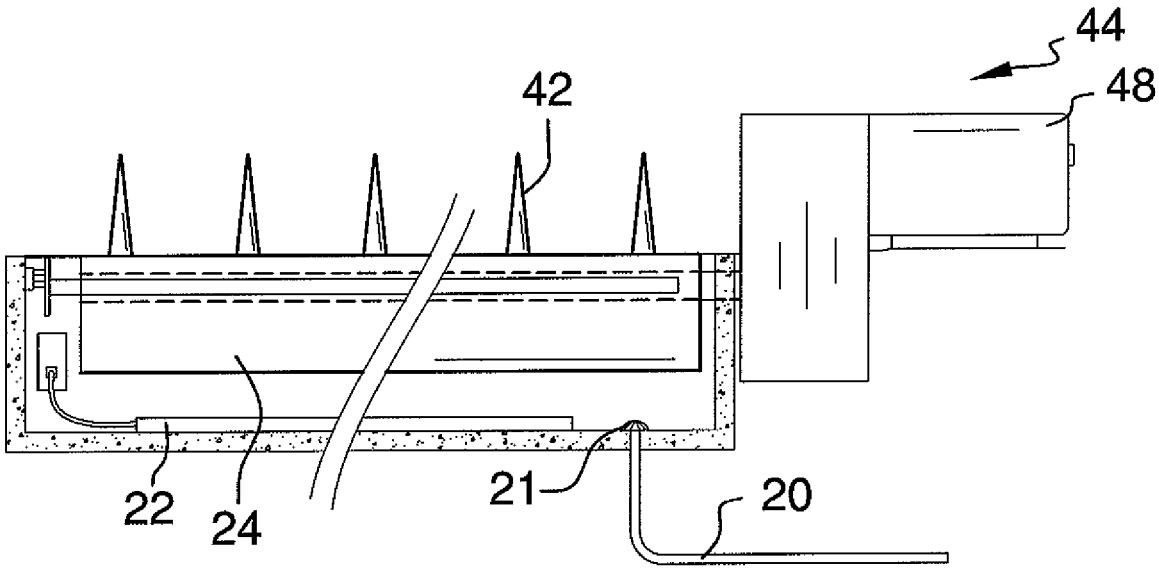
FIG. 11 is a front view of the housing of the present invention showing an alternate motor actuated drive mechanism and heating assembly.

A drive mechanism 44 is mechanically coupled to the housing 24. The drive mechanism 44 is actuated to rotate the housing 24 and move the protrusions 42 to the deployed position or the stored position. FIGS. 2 and 10 depict two different types of manual cranks 46 which are coupled to the housing 24 by gears 47. FIGS. 4 and 11 include an electronic motor 48 coupled to the gears 47 and which rotate the housing 24 when the motor 48 is turned on by a control 50. FIG. 4 places the entire drive mechanism 44 below a ground surface. The control 50 may include a wireless remote actuator 52 or an input actuator 54.

A gate arm 56 is positioned adjacent to the driveway 12. The gate arm 56 may comprise a conventional mechanically actuated gate arm 56 that is selectively positioned in a raised position or a lowered position. The lowered position blocks access to the driveway 12. A gate actuator 58 is mechanically coupled to the gate arm 56 and alternately raises and lowers the gate arm 56. The gate actuator 58 may be electrically coupled to the control 50 such that said gate arm is raised when the housing is rotated.

A display 60 is positioned adjacent to the driveway 12. The display 60 is in electrical communication with the drive mechanism 44 and indicates if a vehicle may safely drive over the trough 16. The display 60 preferably includes an exiting indicator 62 and a restricted indicator 64, each of which may be singularly illuminated depending on the position of the protrusions 42 and, if used, the position of the gate arm 56. In particular the exiting indicator 62 will be illuminated when the gate arm 56 is raised and the protrusions 42 are stored within the trough 16 and not extending upwardly from the trough 16. The control 50 includes a processor 55 programmed to simultaneously actuate the display 60, gate arm actuator 58 and motor 48. If a manual crank 46 hand actuated drive mechanism 44 is used, the display 50 may be manually actuated as needed.

A plurality of spike members 70 is attached to the housing 24. The spike members 70 are aligned with each other from the first end 26 to the second end 28 of the housing 24 and are rigid to be capable of puncturing a vehicle tire 8. The spike members 70 are spaced from the protrusions 42 so that the spike members 70 are positioned within the trough 16 below a plane of the upper surface 14 when the protrusions 42 are deployed. The housing 24 is selectively rotated to extend either the spike members 70 or the protrusions 42 above the plane of the driveway 12. The housing 24 may also be rotated to position each of the spike members 70 and the protrusions 42 within the trough 16. The spike members 70 may include arcuate spike members that allow one-directional driving over them without any puncturing of the tires. FIG. 9 displays a plurality of differently shaped spike members 70 and include a first spike type 71 to allow a first direction of movement over the housing 24, a second spike type 72 to allow a second direction of movement over the housing 24, or a third spike type 73 completely restricting movement over the housing 24. The protrusions 42 define a fourth spike type which appear to restrict movement over the housing 24 but which are only used to deter a vehicle from driving over the housing 24 as opposed to actually being able to prevent the vehicle, by damaging its tires 8, from driving over the housing 24. FIG. 9 also includes a flat portion 38 of the housing 24 which allows for all of the spike types to be placed within the trough 16 and not extending outwardly of the trough 16.

A speed bump 74 may also be mounted on and extended along a length of the housing 24. The speed bump 74 is used to simply cause vehicles to slow down as they drive into the driveway 12 and go over the trough 16.

Figure 12:
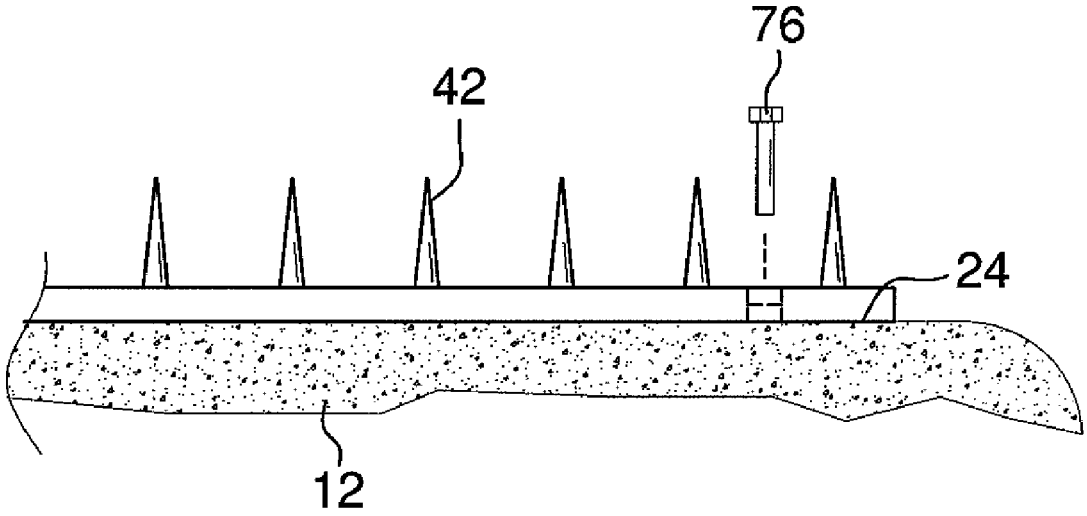
FIG. 12 is a front view of another embodiment of the present invention.
Figure 13:
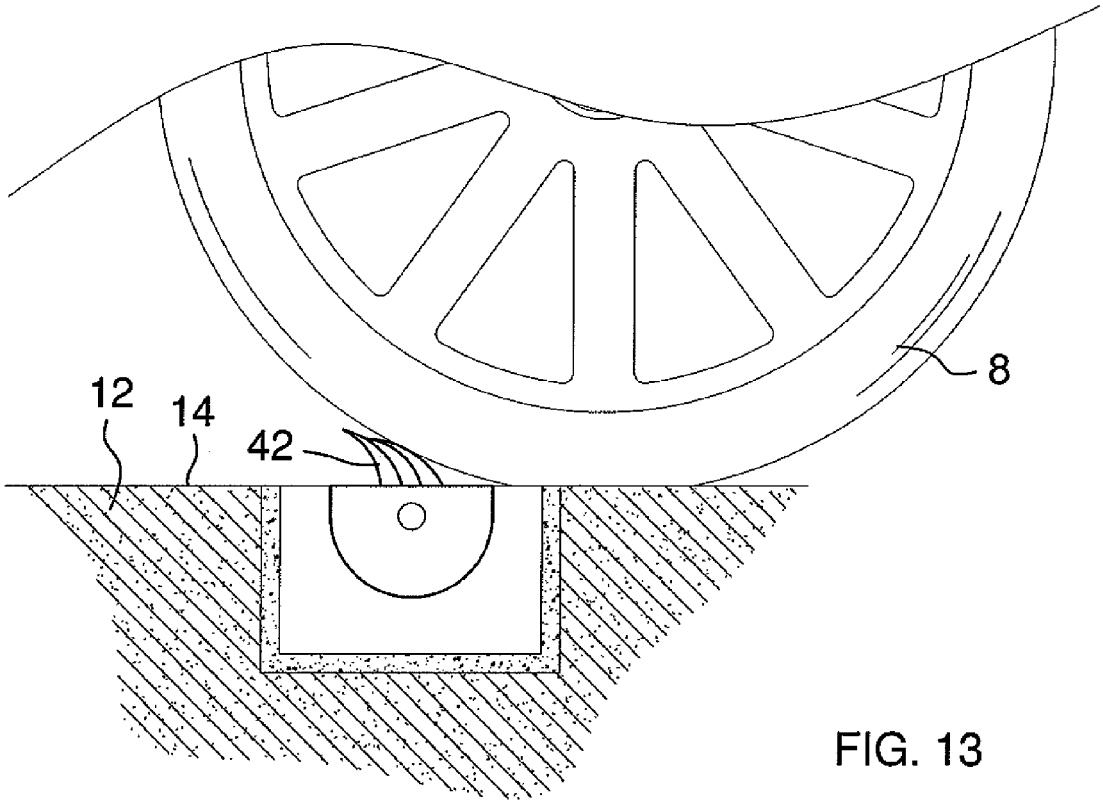
FIG. 13 is a side in-use view of the present invention.
Figure 14:
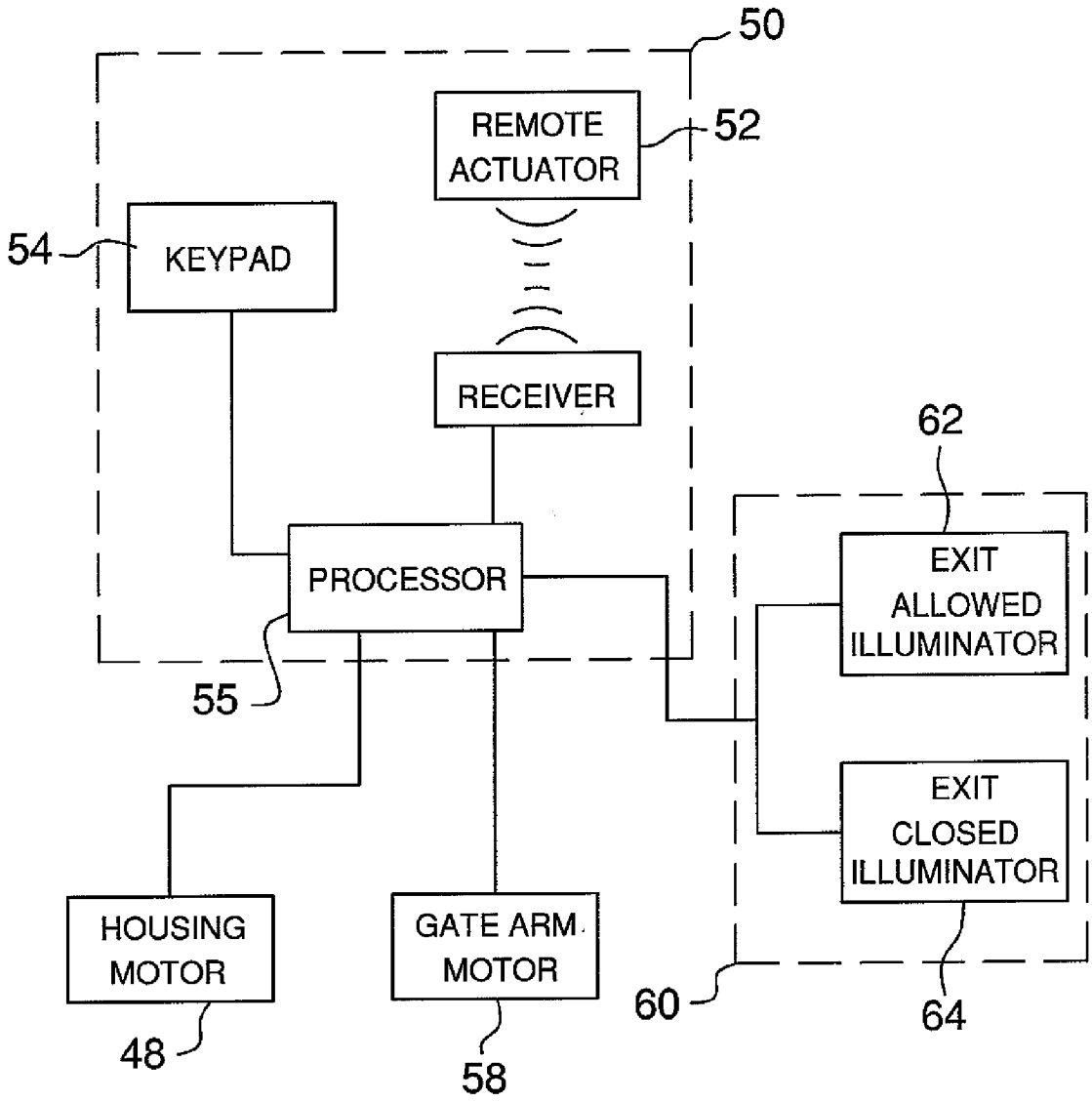
FIG. 14 is a schematic view of the present invention.

FIG. 12 includes an embodiment wherein the housing 24 is attached to the top surface 14 of the driveway 12 and which includes flexible protrusions 42. This embodiment prevents damage to tires 8 but does deter vehicles from driving on the driveway 12. The housing 24 of this embodiment is attached to the driveway 12 with fasteners 76.

In use, the system 10 is primarily used to prevent or deter vehicles from driving into a driveway 12 without risking any actual damage to a vehicle's tires. However, if embodiments are used which include the spikes 70, the user of the system 10 may elect to deploy the spikes 70 at certain times to enforce the stoppage of traffic on the driveway 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A traffic diverting system comprising:

a driveway having an upper surface, a trough extending into said upper surface, said trough being elongated and extending between lateral edges of said driveway;

a housing having a first end and a second end, said first end being rotatably coupled to a first lateral wall of said trough, said second end being rotatably coupled to a second lateral wall of said trough, said housing having a peripheral wall extending between said first and second ends; and a plurality of spike shaped protrusions being attached to and extending away from said peripheral wall, said protrusions being comprised of a resiliently flexible material being incapable of puncturing a vehicle tire, said protrusions being positionable in a deployed position extending upwardly from a plane of said upper surface or in a stored position positioned within said trough.

2. The system according to claim 1, wherein said resiliently flexible material is an elastomeric material.

3. The system according to claim 1 wherein said protrusions are aligned with each from said first end to said second end of said housing.

4. The system according to claim 1, further including a drainage conduit being fluidly coupled to said trough and draining water from said trough.

5. The system according to claim 4, further including a heating assembly being in thermal communication with said trough and warming said trough to a temperature above 0° Celsius.

6. The system according to claim 1, further including a heating assembly being in thermal communication with said trough and warming said trough to a temperature above 0° Celsius.

7. The system according to claim 1, further including a drive mechanism being mechanically coupled to said housing, said drive mechanism being actuated to rotate said housing and move said protrusions to said deployed position or said stored position.

8. The system according to claim 7, wherein said drive mechanism includes a motor mechanically coupled to and rotating said housing when said motor is turned on.

9. The system according to claim 1, further including a gate arm being positioned adjacent to said driveway, said gate arm being selectively positioned in a raised position or a lowered position, said lowered position blocking access to said driveway.

10. The system according to claim 9, further including a gate actuator being mechanically coupled to said gate arm and alternately raising and lowering said gate arm.

11. The system according to claim 7, further including a display being positioned adjacent to said driveway, said display being in electrical communication with said drive mechanism and indicating if a vehicle may safely drive over said trough.

12. The system according to claim 1, further including a plurality of spike members being attached to said housing and aligned with each other from said first end to said second end of said housing, said spike members being rigid and being capable of puncturing a vehicle tire, said spike members being spaced from said protrusions, said housing being selectively rotated to extend either said spike members or said protrusions above said plane of said driveway, said housing being selectively rotated to position each of said spike members and said protrusions within said trough.

13. The system according to claim 12, further including a drive mechanism being mechanically coupled to said housing, said drive mechanism being actuated to rotate said housing and move said protrusions to said deployed position or said stored position.

14. The system according to claim 13, further including a display being positioned adjacent to said driveway, said display being in electrical communication with said drive mechanism and indicating if a vehicle may safely drive over said trough.

15. A traffic diverting system comprising:

a driveway having an upper surface, a trough extending into said upper surface, said trough being elongated and extending between lateral edges of said driveway;

a housing having a first end and a second end, said first end being rotatably coupled to a first lateral wall of said trough, said second end being rotatably coupled to a second lateral wall of said trough, said housing having a peripheral wall extending between said first and second ends;

a plurality of spike shaped protrusions being attached to and extending away from said peripheral wall, said protrusions being comprised of a resiliently flexible material being incapable of puncturing a vehicle tire, said protrusions being positionable in a deployed position extending upwardly from a plane of said upper surface or in a stored position positioned within said trough, said resiliently flexible material being an elastomeric material, said protrusions being aligned with each from said first end to said second end of said housing;

a drainage conduit being fluidly coupled to said trough and draining water from said trough;

a heating assembly being in thermal communication with said trough and warming said trough to a temperature above 0° Celsius;

a drive mechanism being mechanically coupled to said housing, said drive mechanism being actuated to rotate said housing and move said protrusions to said deployed position or said stored position;

a gate arm being positioned adjacent to said driveway, said gate arm being selectively positioned in a raised position or a lowered position, said lowered position blocking access to said driveway;

a gate actuator being mechanically coupled to said gate arm and alternately raising and lowering said gate arm;

a display being positioned adjacent to said driveway, said display being in electrical communication with said drive mechanism and indicating if a vehicle may safely drive over said trough; and a plurality of spike members being attached to said housing and aligned with each other from said first end to said second end of said housing, said spike members being rigid and being capable of puncturing a vehicle tire, said spike members being spaced from said protrusions, said housing being selectively rotated to extend either said spike members or said protrusions above said plane of said driveway, said housing being selectively rotated to position each of said spike members and said protrusions within said trough.

* * * * *